US011410669B2

(12) United States Patent
Bacon

(10) Patent No.: US 11,410,669 B2
(45) Date of Patent: Aug. 9, 2022

(54) ASYMMETRIC MICROPHONE POSITION FOR BEAMFORMING ON WEARABLES FORM FACTOR

(71) Applicant: Bose Corporation, Framingham, MA (US)

(72) Inventor: Cedrik Bacon, Ashland, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 17/184,054

(22) Filed: Feb. 24, 2021

(65) Prior Publication Data

US 2021/0272578 A1 Sep. 2, 2021

Related U.S. Application Data

(60) Provisional application No. 62/982,794, filed on Feb. 28, 2020.

(51) Int. Cl.

| | |
|---|---|
| ***G10L 21/0216*** | (2013.01) |
| ***H04R 1/40*** | (2006.01) |
| ***H04R 3/00*** | (2006.01) |

(52) U.S. Cl.

CPC ..... *G10L 21/0216* (2013.01); *H04R 1/406* (2013.01); *H04R 3/005* (2013.01); *G10L 2021/02166* (2013.01); *H04R 2430/20* (2013.01)

(58) Field of Classification Search

CPC ..... G10L 21/0216; G10L 2021/02166; H04R 1/406; H04R 3/005; H04R 25/43;

(Continued)

(56) References Cited

U.S. PATENT DOCUMENTS 10,567,898 B1 * 2/2020 Asfaw ..... H04N 5/2252
2008/0260189 A1 10/2008 Schobben (Continued)

FOREIGN PATENT DOCUMENTS

| | | | |
|---|---|---|---|
| EP | 3383061 | A1 | 10/2018 |
| EP | 3496417 | A2 | 6/2019 |
| WO | 2010144577 | A1 | 12/2010 |

OTHER PUBLICATIONS

International Search Report and the Written Opinion of the International Searching Authority, International Patent Application No. PCT/US2021/019412, pp. 1-13, dated Jun. 11, 2021.

*Primary Examiner* — Yogeshkumar Patel
(74) *Attorney, Agent, or Firm* — Bond, Schoeneck & King, PLLC

(57) ABSTRACT

A wearable audio device is provided. The wearable audio device may include a first array of microphones linearly arranged on the wearable audio device at a positive angle relative to a horizontal axis of the wearable audio device. The microphones of the first array may be configured to capture far-field audio. The wearable audio device may include a second array of microphones linearly arranged on the wearable audio device at a negative angle relative to the horizontal axis. The microphones of the second array may be configured to capture near-field audio. The wearable audio device may include circuitry arranged to (1) generate a user voice audio signal based on the captured near-field audio, (2) generate a desired audio signal based on the captured far-field audio, and (3) generate a differentiated signal based on the desired audio signal and the user voice audio signal.

20 Claims, 6 Drawing Sheets

(58) Field of Classification Search
CPC .... H04R 25/47; H04R 25/407; H04R 1/1083; H04R 2430/20; G02C 11/06; G06F 3/011; G06F 1/163; A61N 1/36038
See application file for complete search history.

(56) References Cited

U.S. PATENT DOCUMENTS

| | | | | |
|---|---|---|---|---|
| 2010/0323652 | A1* | 12/2010 | Visser | H04R 3/005 455/232.1 |
| 2018/0324511 | A1* | 11/2018 | Asada | H04R 1/10 |
| 2019/0174237 | A1* | 6/2019 | Lunner | G06F 1/163 |
| 2019/0327570 | A1* | 10/2019 | Pontoppidan | A61B 5/165 |

* cited by examiner

ASYMMETRIC MICROPHONE POSITION FOR BEAMFORMING ON WEARABLES FORM FACTOR

CROSS-REFERENCE TO RELATED APPLICATIONS

This application claims the benefit of U.S. Provisional Patent Application Ser. No. 62/982,794 filed Feb. 28, 2020 and entitled "Asymmetric Microphone Position for Beamforming on Wearables Form Factor", the entire disclosure of which is incorporated herein by reference.

BACKGROUND

This disclosure generally relates to systems and methods for asymmetrically positioning microphones on wearable audio devices for improved audio signal processing.

SUMMARY

This disclosure generally relates to systems and methods for asymmetrically positioning microphones on wearable audio devices for improved audio signal processing.

In one aspect, a wearable audio device is provided. The wearable audio device may include a first array of microphones linearly arranged on the wearable audio device at a positive angle relative to a horizontal axis of the wearable audio device. The microphones of the first array may be configured to capture, relative to the wearable audio device, far-field audio.

The wearable audio device may further include a second array of microphones linearly arranged on the wearable audio device at a negative angle relative to the horizontal axis of the wearable audio device. The microphones of the second array may be configured to capture, relative to the wearable audio device, near-field audio.

In an aspect, the wearable audio device may further include circuitry arranged to generate a user voice audio signal based on the captured near-field audio. The circuitry may be further arranged to generate a desired audio signal based on the captured far-field audio. The circuitry may be further arranged to generate a differentiated signal based on the desired audio signal and the user voice audio signal. In an example, the differentiated signal may be generated by subtracting the user voice audio signal from the desired audio signal.

According to an example, the first array of microphones may include a noise-capturing subset of microphones proximate to a first distal end of the wearable audio device. The noise-capturing subset of microphones may be configured to capture rear-field audio.

According to an example, the wearable audio device may further include circuitry arranged to generate a rear noise audio signal based on the captured rear-field audio. The circuitry may be further arranged to generate a desired audio signal based on the captured far-field audio. The circuitry may be further arranged to generate a noise-rejected signal based on the desired audio signal and the rear noise audio signal. The noise-rejected audio signal may be generated by subtracting the rear noise audio signal from the desired audio signal.

According to an example, the second array of microphones may include a noise-capturing subset of microphones proximate to a second distal end of the wearable audio device. The noise-capturing subset of microphones may be configured to capture rear-field audio.

According to an example, the first array of microphones may consist of two microphones.

According to an example, the microphones of the first and second array are omnidirectional.

According to an example, the wearable audio device may be a set of audio eyeglasses. The first array of microphones may be arranged proximate to a temple area of the audio eyeglasses.

According to an example, the near-field audio may include sound audible within 60 centimeters of the wearable audio device. The far-field audio may include sound audible beyond 60 centimeters from the wearable audio device.

According to an example, the positive angle of the first array of microphones may be less than the negative angle of the second array of microphones. The positive angle may be 30 degrees. The negative angle may be 45 degrees.

In another aspect, a method for capturing and processing audio with a wearable audio device is provided. The method may include capturing, via a first array of microphones linearly arranged on a wearable audio device at a positive angle relative to a horizontal axis of the wearable audio device, near-field audio. The method may further include capturing, via a second array of microphones linearly arranged on a wearable audio device at a negative angle relative to a horizontal axis of the wearable audio device, far-field audio.

According to an example, the method may further include generating, via circuitry of the wearable audio device, a user voice audio signal based on the captured near-field audio. The method may further include generating, via circuitry of the wearable audio device, a desired audio signal based on the captured far-field audio. The method may further include generating, via circuitry of the wearable audio device, a differentiated signal based on the desired audio signal and the user voice audio signal.

According to an example, the method may further include capturing, via a noise capturing subset of the first array of microphones, rear-field audio. The microphones of the noise capturing subset may be proximate to a distal end of the wearable audio device.

According to an example, the method may further include generating, via circuitry of the wearable audio device, a rear noise audio signal based on the captured rear-field audio. The method may further include generating, via circuitry of the wearable audio device, a desired audio signal based on the captured far-field audio. The method may further include generating, via circuitry of the wearable audio device, a noise-rejected signal based on the desired audio signal and the rear noise audio signal.

Other features and advantages will be apparent from the description and the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various examples.

DETAILED DESCRIPTION

This disclosure is related to systems and methods for asymmetrically positioning microphones on wearable audio devices (also referred to as "wearables") for improved audio signal processing. The resultant signal may be broadcast to the user via an audio transducer, such as a speaker arranged in a hearing aid. The asymmetric nature of the two microphone arrays allows for the arrays to capture two types of audio: (1) far-field audio, comprising the audio the user wishes to hear via the wearable, such as an individual speaking to the user; and (2) near-field audio, comprising of the user's own vocal audio. The microphone array angled upward, relative to a horizontal axis of the wearable, may be configured to capture the desired far-field audio. The microphone array similarly angled downward may be configured to capture the undesired near-field audio. Identifying the different types of audio in this manner allows for the wearable to focus on the desired audio during processing to improve the resultant audio heard by the user, such as by removing or minimizing portions of the undesired audio signal. In further examples, a subset of the microphones in one or both of the arrays may be used to capture background noise audio. This background noise audio may similarly be removed from or minimized in the desired audio signal in a similar manner as the near-field audio.

The term "wearable audio device", as used in this application, is intended to mean a device that fits around, on, in, or near an ear (including open-ear audio devices worn on the head or shoulders of a user) and that radiates acoustic energy into or towards the ear. Wearable audio devices can be wired or wireless. A wearable audio device includes an acoustic driver to transduce audio signals to acoustic energy. A wearable audio device may include components for wirelessly receiving audio signals. A wearable audio device may include components of an active noise reduction (ANR) system. Wearable audio devices may also include other functionality such as a microphone so that they can function as a headset. In some examples, a wearable audio device may be an open-ear device that includes an acoustic driver to radiate acoustic energy towards the ear while leaving the ear open to its environment and surroundings.

Figure 1A:
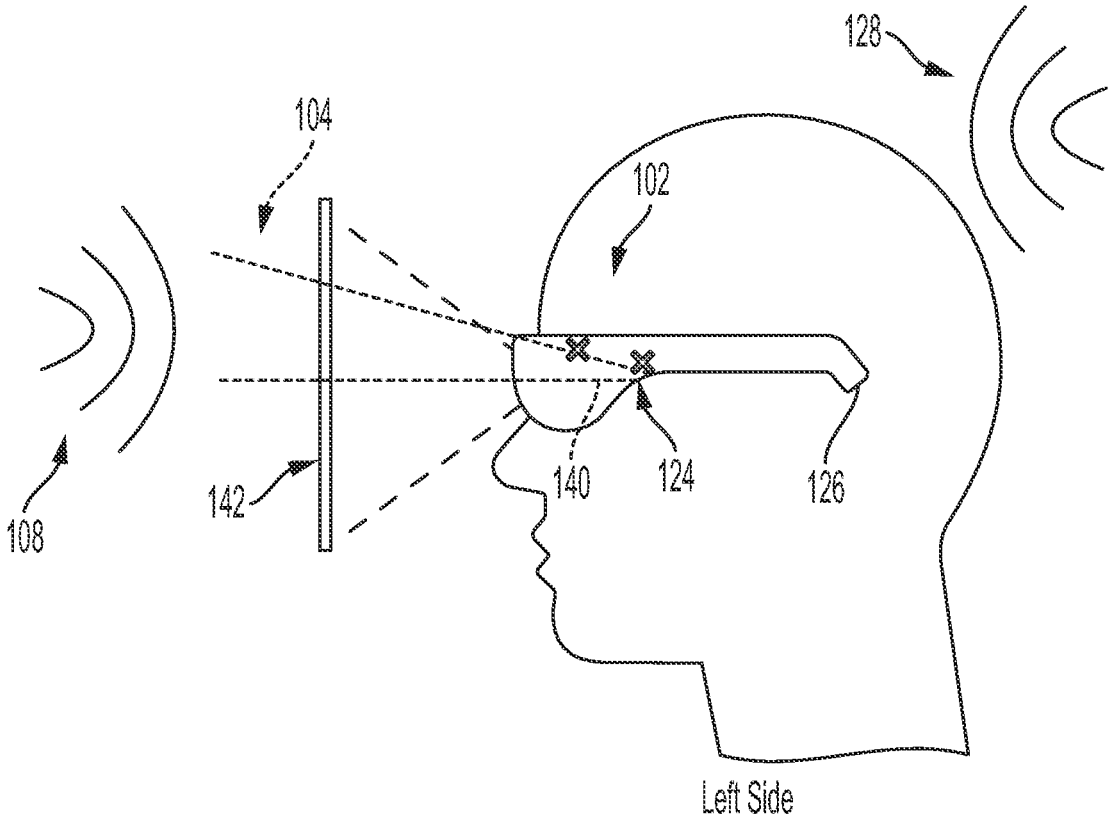
FIGS. 1A and 1B are left-side and right-side views, respectively, of the wearable audio device, according to an example.

In one aspect, and with reference to FIGS. 1A-2B, a wearable audio device 100 is provided. In a preferred embodiment, and as shown in FIGS. 1A and 1B, representing the right and left side, respectively, of a user wearing the wearable audio device 100, the wearable audio device 100 may be a set of audio eyeglasses. The wearable audio device 100 may include a first array of microphones 102 linearly arranged on the wearable audio device 100 at a positive angle 104 relative to a horizontal axis 106 of the wearable audio device 100. This positive angle 104 is shown as a dashed line connecting the microphones of array 102 in FIG. 1A. The horizontal axis 106 may be defined as following the temples of the audio eyeglasses shown in FIGS. 1A and 1B. In other embodiments, alternative axes may be utilized to define the angles of the first 102 and second 110 microphone arrays. The microphones of the first array 102 may be configured to capture, relative to the wearable audio device 100, far-field audio 108. As shown in FIG. 1A, the far-field audio 108 originates beyond vertical axis 142. The far-field audio 108 may comprise any sound the user of the wearable audio device 100 wishes to hear with improved quality, such as speech from a conversation partner or audio from an entertainment system. As stated above, the goal of the disclosed wearable audio device 100 is to identify and enhance this desired far-field audio 108 such that the user may hear it with greater clarity.

Figure 1B:
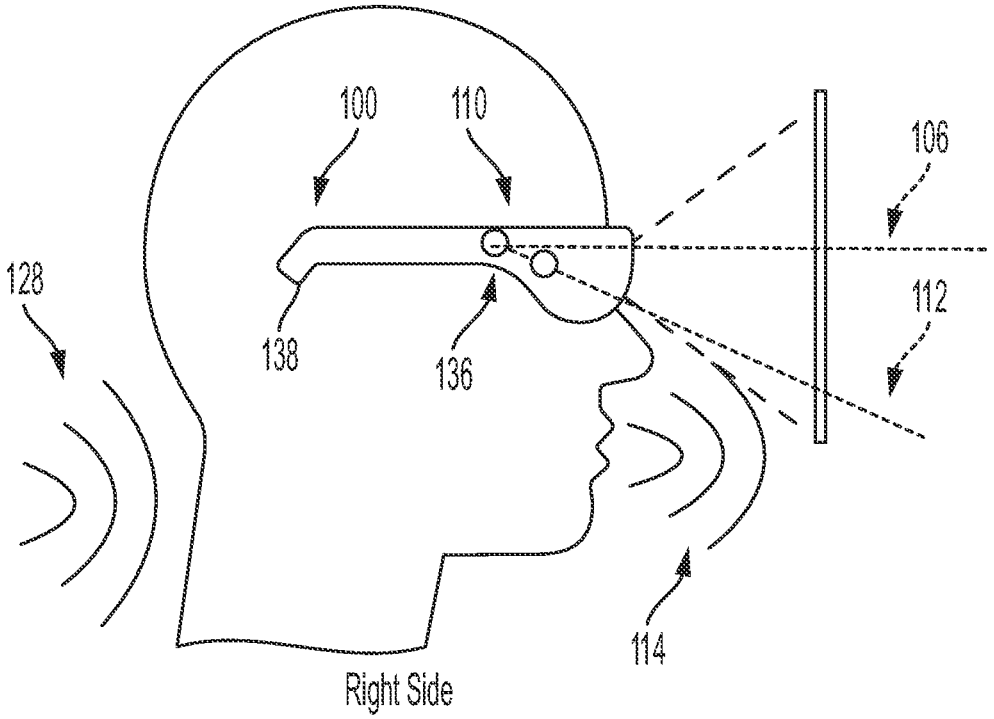

As shown in FIG. 1B, the wearable audio device 100 may further include a second array of microphones 102 linearly arranged on the wearable audio device 100 at a negative angle 112 relative to the horizontal axis 106 of the wearable audio device. This negative angle 112 is shown as a dashed line connecting the microphones of array 110 in FIG. 1B. The microphones of the second array 110 may be configured to capture, relative to the wearable audio device 100, near-field audio 114. As shown in FIG. 1B, the near-field audio 114 comprises the audio originating from the mouth of the user, such as speech. By identifying the captured near-field audio 114 as user voice audio, the wearable audio device 100 may improve the quality of the audio ultimately produced for the user by a hearing aid speaker or other device by minimizing or entirely removing the near-field audio 114 from the audio signal.

Figure 2A:
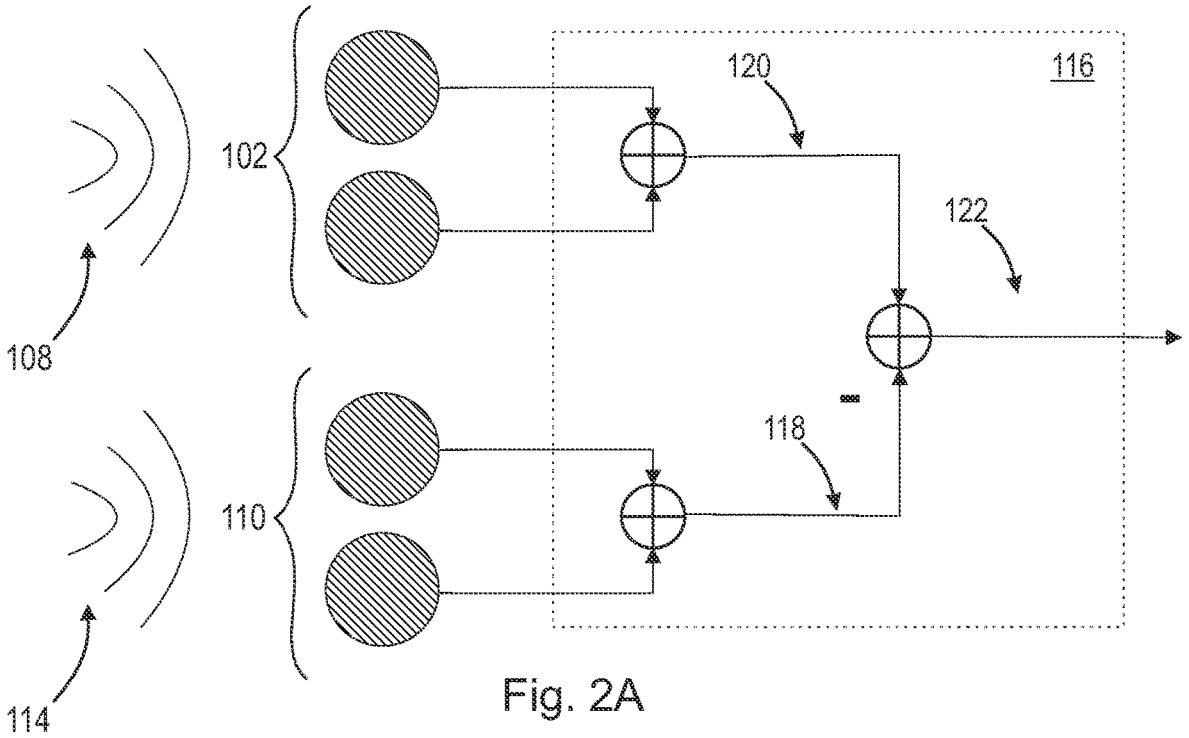
FIGS. 2A and 2B are signal processing schematics for the differentiated and noise-rejected examples of the wearable audio device.

In an aspect, and with reference to FIG. 2A, the wearable audio device 100 may further include circuitry 116 arranged to generate a user voice audio signal 118 based on the captured near-field audio 114. As shown in FIG. 2A, the second microphone array 110 captures near-field audio 114. The near-field audio 114 captured by each microphone of the array 110 may be converted into an electrical signal by the microphone and processed by the circuitry 116 to generate the user audio signal 118. The generation of the user audio signal 118 may include summing, filtering, amplifying, phase shifting, and/or otherwise processing one or more of the electrical signals generated by the microphones of the second array 110. FIG. 2A shows an example wherein the electrical signal from the two microphones of array 110 are summed. This summation may occur via, for example, a summing amplifier. The signal processing of the electrical signals may be implemented via any practical discrete components and/or integrated circuits.

The circuitry 116 may be further arranged to generate a desired audio signal 120 based on the captured far-field audio 108. As shown in FIG. 2A, the first microphone array 102 captures far-field audio 108. The far-field audio 108 captured by each microphone of the array 102 may be converted into an electrical signal by the microphone and processed by the circuitry 116 to generate the desired audio signal 120. The generation of the user audio signal 120 may include summing, filtering, amplifying, phase shifting, and/or otherwise processing one or more of the electrical signals generated by the microphones of the first array 102. FIG. 2A shows an example wherein the electrical signal from the two microphones of array 102 are summed. This summation may occur via, for example, a summing amplifier. The signal processing of the electrical signals may be implemented via any practical discrete components and/or integrated circuits.

The circuitry 116 may be further arranged to generate a differentiated signal 122 based on the desired audio signal 120 and the user voice audio signal 118. The differentiated signal 122 represents audio to be played back to the user via one or more speakers of the wearable audio device 100. In an example, and as shown in FIG. 2A, the differentiated signal 122 may be generated by subtracting the user voice audio signal 118 from the desired audio signal 120. Prior to the generation of the differentiated signal 122, the desired audio signal 120 and/or the user voice signal 118 may be filtered, amplified, attenuated, or otherwise processed to improve the resulting differentiated signal 122. Similarly, following its generation, the differentiated signal 122 may be filtered, amplified, attenuated, or otherwise processed prior to transmission to one or more speakers of the wearable audio device 100 for playback to the user.

According to an example, the first array of microphones 102 may include a noise-capturing subset of microphones 124 proximate to a first distal end 126 of the wearable audio device 100. As shown in FIG. 1A, the subset 124 may include the rear-most microphone of the array 102. In other examples, the subset 124 may include multiple microphones positioned proximate to the first distal end 126. The first distal end 126 may be a temple tip at the end of a temple of audio eyeglasses. The noise-capturing subset of microphones 124 may be configured to capture rear-field audio 128. The rear-field audio 128 may comprise background noise or other audio the user wishes to suppress relative to far-field audio 108.

Figure 2B:
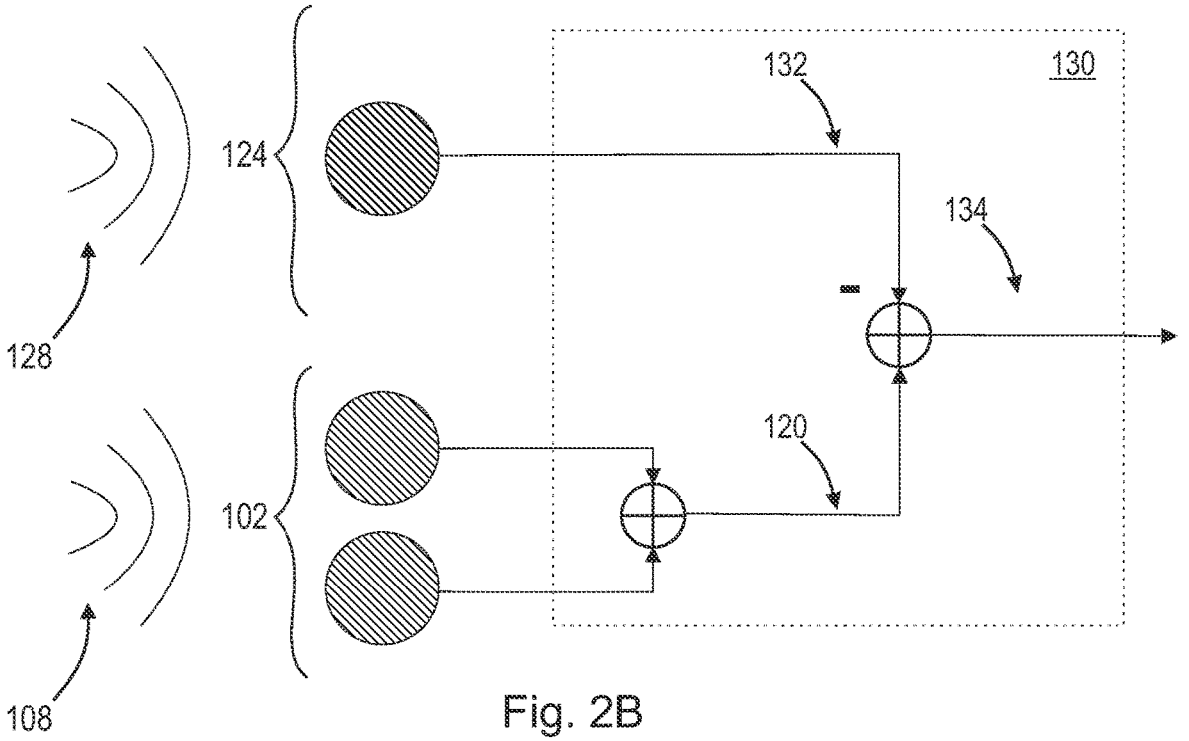

According to an example, and as shown in FIG. 2B the wearable audio device 100 may further include circuitry 130 arranged to generate a rear noise audio signal 132 based on the captured rear-field audio 128. As shown in FIG. 2A, the noise-capturing subset 124 captures rear-field audio 128. The circuitry 130 may be further arranged to generate a desired audio signal 120 based on the captured far-field audio 108 as described above.

The circuitry 130 may be further arranged to generate a noise-rejected signal 134 based on the desired audio signal 120 and the rear noise audio signal 132. The noise-rejected signal 134 represents audio to be played back to the user via one or more speakers of the wearable audio device 100. In an example, and as shown in FIG. 2A, the noise-rejected audio signal 134 may be generated by subtracting the rear noise audio signal 132 from the desired audio signal 120. Prior to the generation of the noise-rejected signal 134, the desired audio signal 120 and/or the rear noise audio signal 132 may be filtered, amplified, attenuated, or otherwise processed to improve the noise-rejected signal 134. Similarly, following its generation, the noise-rejected signal 134 may be filtered, amplified, attenuated, or otherwise processed prior to transmission to one or more speakers of the wearable audio device 100 for playback to the user.

In a further example, the circuitry shown in FIGS. 2A and 2B may be combined to generate a resultant signal conveying the desired audio of the far-field 108 while suppressing both the near-field 114 and rear-field 128 audio.

According to an example, the second array of microphones 110 may include a noise-capturing subset of microphones 136 proximate to a second distal end 138 of the wearable audio device 100. The noise-capturing subset of microphones 136 may be configured to capture rear-field audio 128. The electrical signals generated by the noise-capturing subset 136 of the second array 110 may be used independently or in conjunction with the subset 124 of the first array 102 to identify background noise.

According to an example, the first 102 and/or second 110 arrays of microphones may consist of two microphones. In an example wherein the wearable 100 is a set of audio eyeglasses, a first microphone may be located proximate to the rim of the eyeglasses, while a second microphone may be located proximate to a temple tip of the eyeglasses. In further examples, the first 102 and second 110 arrays of microphones may each consist of any number of microphones required to adequately capture far-field 108 and/or near-field 114 audio. Specifically, using more than two microphones in an array may increase the directionality of far-field 108 pick-up. In additional examples, one of the arrays may consist of a single omnidirectional microphone, while the other array may consist of two or more microphones arranged as described above.

According to an example, the microphones of the first 102 and second 110 arrays of microphones are omnidirectional. In further examples, the microphones may be of any type conducive for capturing audio in the near-, far-, and rear-fields, such as unidirectional or bidirectional.

According to an example, the first 102 and/or second 110 arrays of microphones may be arranged proximate to a temple area 140 of the audio eyeglasses. In a preferred example, the second array of microphones 110 are placed as close to the rims of the audio eyeglasses as possible. In a further example, the user's voice may be most consistently measured across the frequency range of 500 Hz to 4 kHz near the front of the audio eyeglasses. In particular, voice audio in the 500 Hz and 1 kHz range attenuates significantly toward the temple tips of the eyeglasses.

According to an example, the near-field audio 114 may include sound audible within 30-60 centimeters of the wearable audio device 110. The far-field 114 audio may include sound audible beyond 30-60 centimeters from the wearable audio device 110. The boundary between near and far field may be represented by vertical axis 142 of FIGS. 1A and 1B. This boundary may be adjusted according to the application of the wearable audio device 100.

According to an example, the positive angle 104 of the first array of microphones 102 may be less than the negative angle 112 of the second array of microphones 110. The positive angle 104 may be 30 degrees. The negative angle 112 may be 45 degrees. In a further example, the positive 104 and negative 112 angles may be congruent about the horizontal axis 106.

According to an example, the first 102 and second 110 arrays of microphones may each be used to capture far-field audio 108. In this example, each array 102, 110 may be used to capture a different aspect of far-field audio 108, and combine each aspect in an additive process to create an electrical signal more representative of the far-field audio 108 than a signal from a single array. In this arrangement, the near-field rejection aspects of the wearable audio device 100 may be diminished relative to the other embodiments.

Figure 3:
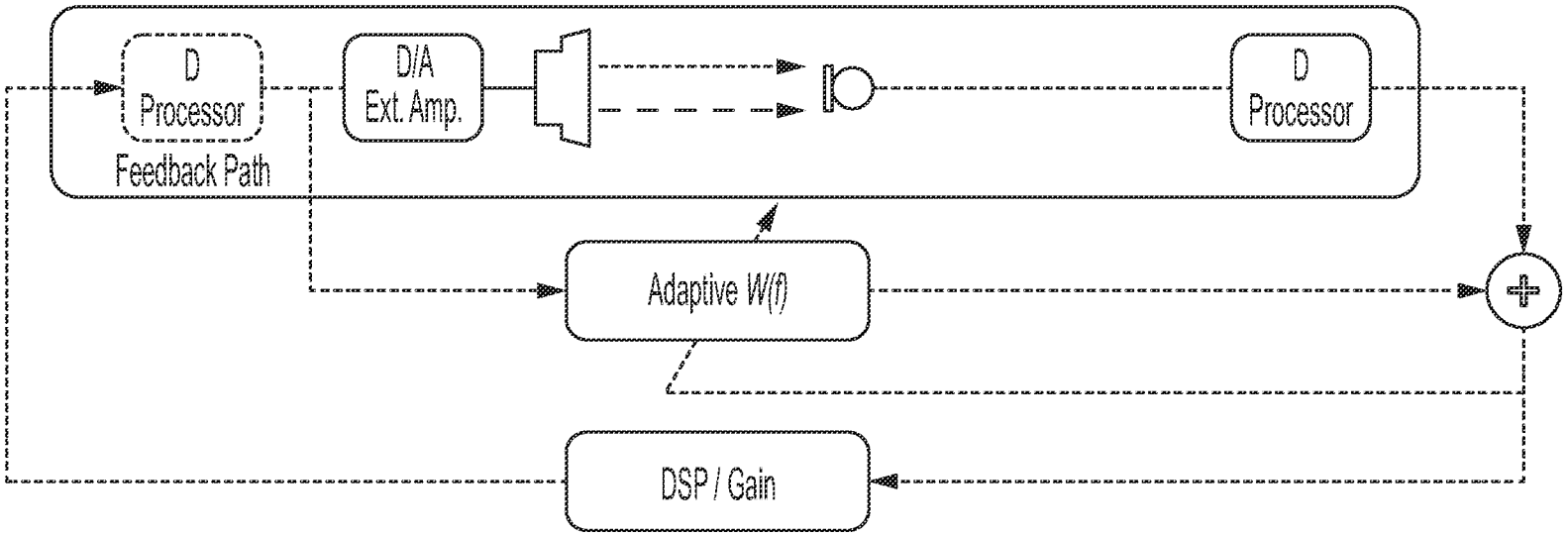
FIG. 3 is a simplified schematic of an audio system with adaptive filtering to minimize feedback, according to an example.
Figure 4:
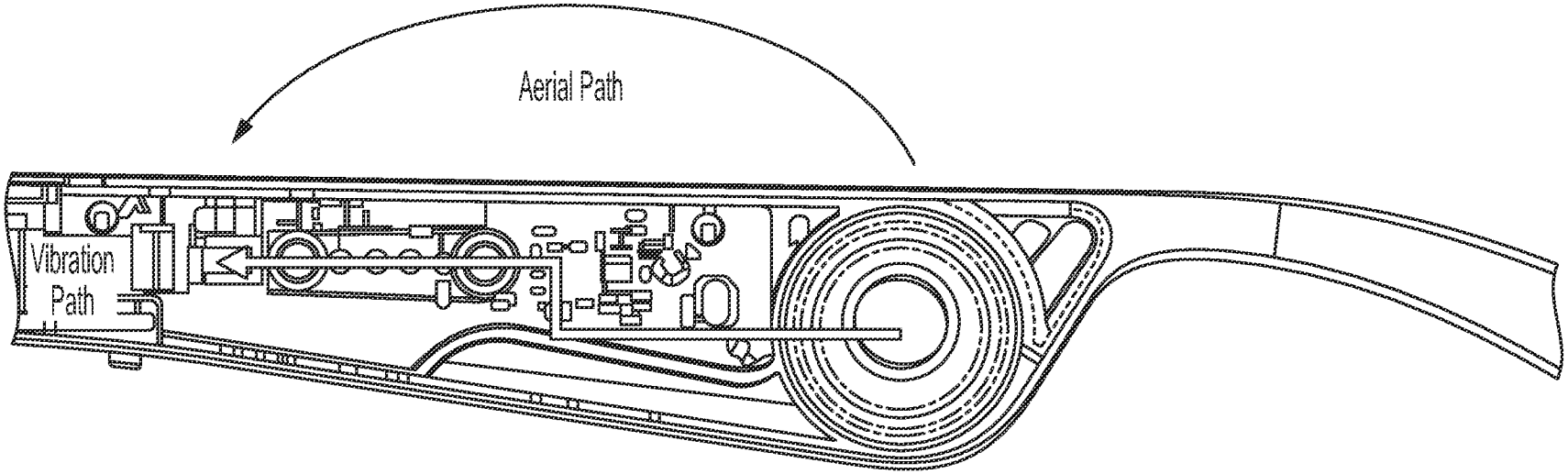
FIG. 4 is an internal mechanical layout demonstrating feedback paths in a wearable audio device, according to an example.

In a further example, the aforementioned microphone arrays 102, 110 may be used in conjunction with the structure of the schematic shown in FIG. 3 used to minimize undesired audio and/or mechanical vibrations generated by one or more output speakers and incident upon the microphones. FIG. 4 illustrates how the audio and/or mechanical vibrations generated by the output speakers may cause feedback through the audio and mechanical paths. In FIG. 4, the "vibration path" represents the mechanical vibrations which travel through the body of the wearable 100 and cause the microphone arrays 102, 110 to similarly vibrate, while the "aerial path" represents the audio emitting by the speaker which may be picked up by the microphone arrays 102, 110. As shown in FIG. 3, adaptive filtering may be used in conjunction with digital signal processing algorithms to suppress frequencies prone to feedback. In further examples, the noise-capturing subsets 124, 136 may be used to identify and diagnose feedback in the system, such as ringing or squealing.

Figure 5:
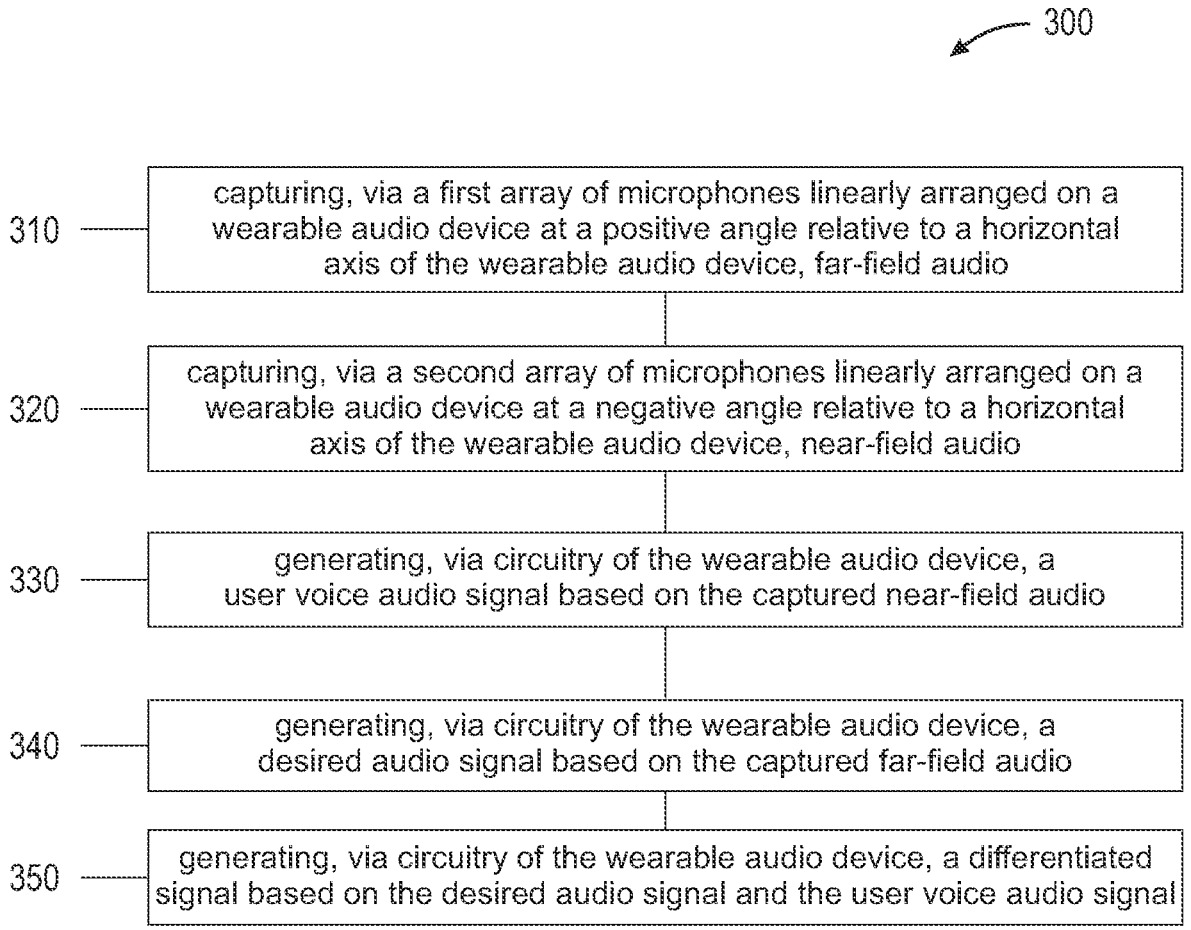
FIG. 5 is a flowchart of a differentiated example of the present disclosure.
Figure 6:
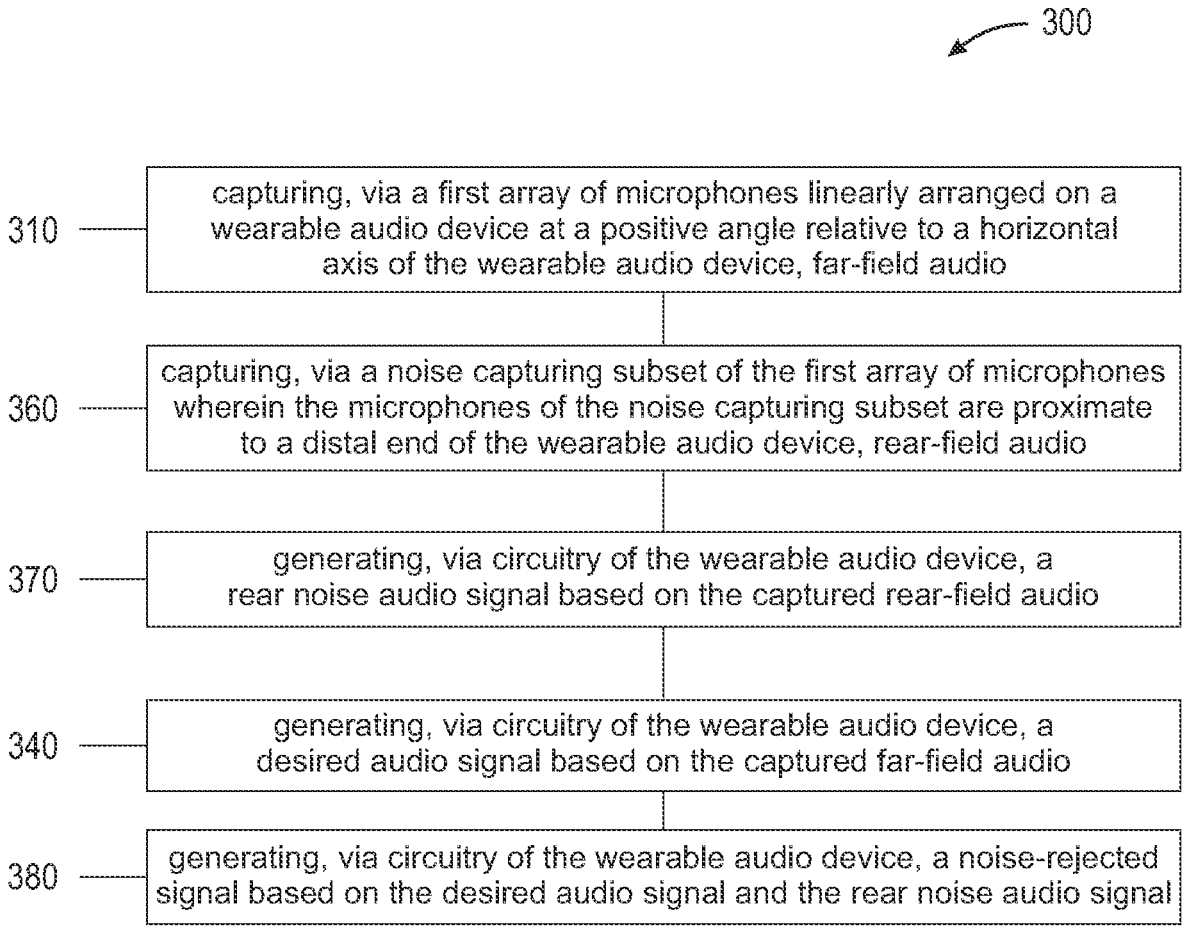
FIG. 6 is a flowchart of a noise-rejected example of the present disclosure.

In another aspect, and with respect to FIGS. 5 and 6, a method 300 for capturing and processing audio with a wearable audio device is provided. The method 300 may include capturing 310, via a first array of microphones linearly arranged on a wearable audio device at a positive angle relative to a horizontal axis of the wearable audio device, near-field audio. The method 300 may further include capturing 320, via a second array of microphones linearly arranged on a wearable audio device at a negative angle relative to a horizontal axis of the wearable audio device, far-field audio.

According to an example, the method 300 may further include generating 330, via circuitry of the wearable audio device, a user voice audio signal based on the captured near-field audio. The method 300 may further include generating 340, via circuitry of the wearable audio device, a desired audio signal based on the captured far-field audio. The method 300 may further include generating 350, via circuitry of the wearable audio device, a differentiated signal based on the desired audio signal and the user voice audio signal.

According to an example, the method 300 may further include capturing 360, via a noise capturing subset of the first array of microphones, rear-field audio. The microphones of the noise capturing subset may be proximate to a distal end of the wearable audio device.

According to an example, the method 300 may further include generating 370, via circuitry of the wearable audio device, a rear noise audio signal based on the captured rear-field audio. The method 300 may further include generating 340, via circuitry of the wearable audio device, a desired audio signal based on the captured far-field audio. The method 300 may further include generating 380, via circuitry of the wearable audio device, a noise-rejected signal based on the desired audio signal and the rear noise audio signal.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of" "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The above-described examples of the described subject matter can be implemented in any of numerous ways. For example, some aspects may be implemented using hardware, software or a combination thereof. When any aspect is implemented at least in part in software, the software code can be executed on any suitable processor or collection of processors, whether provided in a single device or computer or distributed among multiple devices/computers.

The present disclosure may be implemented as a system, a method, and/or a computer program product at any possible technical detail level of integration. The computer program product may include a computer readable storage medium (or media) having computer readable program instructions thereon for causing a processor to carry out aspects of the present disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some examples, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, apparatus (systems), and computer program products according to examples of the disclosure. It will be understood that each block of the flowchart illustrations and/or block diagrams, and combinations of blocks in the flowchart illustrations and/or block diagrams, can be implemented by computer readable program instructions.

The computer readable program instructions may be provided to a processor of a, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various examples of the present disclosure. In this regard, each block in the flowchart or block diagrams may represent a module, segment, or portion of instructions, which comprises one or more executable instructions for implementing the specified logical function (s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Other implementations are within the scope of the following claims and other claims to which the applicant may be entitled.

While various examples have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the examples described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific examples described herein. It is, therefore, to be understood that the foregoing examples are presented by way of example only and that, within the scope of the appended claims and equivalents thereto, examples may be practiced otherwise than as specifically described and claimed. Examples of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

What is claimed is:

1. A wearable audio device, comprising:

a first array of microphones linearly arranged on the wearable audio device at a positive angle relative to a horizontal axis of the wearable audio device, wherein the first array of microphones are configured to capture, relative to the wearable audio device, far-field audio, wherein the horizontal axis follows a temple of the wearable audio device; and a second array of microphones linearly arranged on the wearable audio device at a negative angle relative to the horizontal axis of the wearable audio device, wherein the second array of microphones are configured to capture, relative to the wearable audio device, near-field audio.

2. The wearable audio device of claim 1, further comprising circuitry arranged to: generate a user voice audio signal based on the captured near-field audio; generate a far-field audio signal based on the captured far-field audio; and generate a differentiated signal based on the far-field audio signal and the user voice audio signal.

3. The wearable audio device of claim 2, wherein the differentiated signal is generated by subtracting the user voice audio signal from the far-field audio signal.

4. The wearable audio device of claim 1, wherein the first array of microphones comprise a noise-capturing subset of microphones proximate to a first distal end of the wearable audio device, wherein the noise-capturing subset of microphones are configured to capture rear-field audio.

5. The wearable audio device of claim 4, further comprising circuitry arranged to:

generate a rear noise audio signal based on the captured rear-field audio;

generate a far-field audio signal based on the captured far-field audio; and generate a noise-rejected signal based on the far-field audio signal and the rear noise audio signal.

6. The wearable audio device of claim 5, wherein the noise-rejected audio signal is generated by subtracting the rear noise audio signal from the far-field audio signal.

7. The wearable audio device of claim 4, wherein the second array of microphones comprise a noise-capturing subset of microphones proximate to a second distal end of the wearable audio device, wherein the noise-capturing subset of microphones are configured to capture rear-field audio.

8. The wearable audio device of claim 1, wherein the first array of microphones consists of two microphones.

9. The wearable audio device of claim 1, wherein the microphones of the first and second array of microphones are omnidirectional.

10. The wearable audio device of claim 1, wherein the wearable audio device is a set of audio eyeglasses.

11. The wearable audio device of claim 1, wherein the first array of microphones are arranged proximate to the temple of the wearable audio device.

12. The wearable audio device of claim 1, wherein the second array of microphones is configured to capture sound audible within 60 centimeters of the wearable audio device.

13. The wearable audio device of claim 1, wherein the first array of microphones is configured to capture sound audible beyond 60 centimeters from the wearable audio device.

14. The wearable audio device of claim 1, wherein the positive angle of the first array of microphones is less than the negative angle of the second array of microphones.

15. The wearable audio device of claim 1, wherein the positive angle is 30 degrees.

16. The wearable audio device of claim 1, wherein the negative angle is 45 degrees.

17. A method for capturing and processing audio with a wearable audio device, comprising:

capturing, via a first array of microphones linearly arranged on a wearable audio device at a positive angle relative to a horizontal axis of the wearable audio device, far-field audio, wherein the horizontal axis follows a temple of the wearable audio device; and capturing, via a second array of microphones linearly arranged on a wearable audio device at a negative angle relative to the horizontal axis of the wearable audio device, near-field audio.

18. The method of claim 17, further comprising:

generating, via circuitry of the wearable audio device, a user voice audio signal based on the captured near-field audio;

generating, via circuitry of the wearable audio device, a far-field audio signal based on the captured far-field audio; and generating, via circuitry of the wearable audio device, a differentiated signal based on the far-field audio signal and the user voice audio signal.

19. The method of claim 17, further comprising capturing, via a noise capturing subset of the first array of microphones wherein the microphones of the noise capturing subset are proximate to a distal end of the wearable audio device, rear-field audio.

20. The method of claim 19, further comprising: generating, via circuitry of the wearable audio device, a rear noise audio signal based on the captured rear-field audio; generating, via circuitry of the wearable audio device, a far-field audio signal based on the captured far-field audio; and generating, via circuitry of the wearable audio device, a noise-rejected signal based on the far-field audio signal and the rear noise audio signal.

* * * * *